US011123583B2

(12) United States Patent
Nestelroad et al.

(10) Patent No.: US 11,123,583 B2
(45) Date of Patent: Sep. 21, 2021

(54) EMERGENCY AIRCRAFT PASSENGER OXYGEN RESPIRATOR

(71) Applicants: Jackson Nestelroad, Edmond, OK (US); Ethan Williams, Edmond, OK (US); Emily Fletcher, Edmond, OK (US)

(72) Inventors: Jackson Nestelroad, Edmond, OK (US); Ethan Williams, Edmond, OK (US); Emily Fletcher, Edmond, OK (US)

( * ) Notice: Subject to any disclaimer, the term of this patent is extended or adjusted under 35 U.S.C. 154(b) by 819 days.

(21) Appl. No.: 15/932,750

(22) Filed: Apr. 19, 2018

(65) Prior Publication Data

US 2019/0321663 A1 Oct. 24, 2019

(51) Int. Cl.

| | |
|---|---|
| ***A62B 18/02*** | (2006.01) |
| ***A62B 18/08*** | (2006.01) |
| ***A62B 18/10*** | (2006.01) |
| ***A62B 7/10*** | (2006.01) |

(52) U.S. Cl.

CPC ..... *A62B 18/025* (2013.01); *A62B 18/084* (2013.01); *A62B 18/10* (2013.01); *A62B 7/10* (2013.01)

(58) Field of Classification Search

CPC .... A62B 7/10; A62B 7/12; A62B 7/14; A62B 18/02; A62B 18/025; A62B 23/02

See application file for complete search history.

(56) References Cited

U.S. PATENT DOCUMENTS

| | | | | |
|---|---|---|---|---|
| 3,073,301 | A * | 1/1963 | Hay | F16K 31/44 128/205.24 |
| 4,793,342 | A * | 12/1988 | Haber | A62B 9/04 128/202.27 |
| 4,850,346 | A * | 7/1989 | Michel | A62B 18/025 128/206.15 |
| 4,886,058 | A * | 12/1989 | Brostrom | A62B 18/08 128/206.12 |
| 5,265,597 | A * | 11/1993 | Wallis | A62B 18/025 128/205.17 |
| 5,709,204 | A * | 1/1998 | Lester | A62B 7/10 128/205.25 |
| 6,659,102 | B1 | 12/2003 | Sico | |
| 8,505,536 | B2 | 8/2013 | Kielow | |
| 9,393,448 | B2 | 7/2016 | Dwyer | |
| 9,750,960 | B2 | 9/2017 | Fleming | |
| 2003/0183233 | A1* | 10/2003 | Chang | A62B 23/02 128/205.29 |

(Continued)

*Primary Examiner* — Valerie L Woodward

(74) *Attorney, Agent, or Firm* — Randal Homburg

(57) ABSTRACT

An improved emergency aircraft oxygen respirator for passenger use in an aircraft providing a mask attached to a passenger by a head strap, the mask having a facial conforming inner liner forming an airtight seal to each various passenger, the mask further defining an oxygen line connection, a valve operated expired breathing opening, and at least one inlet filter to remove toxic fumes, chemical vapors and smoke during a fire or electrical malfunction in the airplane, the oxygen line connection engaging the plane's existing chemical oxygen generation system, replacing the oxygen mask for passengers in a plane, the replacement respirator deploying within the passenger compartment of the airplane in the same manner as the oxygen masks being replaced.

5 Claims, 5 Drawing Sheets

(56) References Cited

U.S. PATENT DOCUMENTS

| | | | | |
|---|---|---|---|---|
| 2004/0025880 | A1* | 2/2004 | Capon | A62B 23/02<br>128/206.15 |
| 2010/0000536 | A1* | 1/2010 | Rittner | A62B 7/14<br>128/205.24 |
| 2015/0128936 | A1 | 5/2015 | Flannigan | |
| 2015/0217146 | A1 | 8/2015 | Skov | |

* cited by examiner

EMERGENCY AIRCRAFT PASSENGER OXYGEN RESPIRATOR

BACKGROUND OF THE INVENTION

Field of Invention

An improved emergency aircraft oxygen respirator for passenger use in an aircraft providing a mask attached to a passenger by a head strap, the mask having a facial conforming inner liner forming an airtight seal to each various passenger, the mask further defining an oxygen line connection, a valve operated expired breathing opening, and at least one inlet filter to remove toxic fumes, chemical vapors and smoke during a fire or electrical malfunction in the airplane, the oxygen line connection engaging the plane's existing chemical oxygen generation system, replacing the oxygen mask for passengers in a plane, the replacement respirator deploying within the passenger compartment of the airplane in the same manner as the oxygen masks being replaced.

Description of Prior Art

A preliminary review of prior art patents was conducted by the applicant which reveal prior art patents in a similar field or having similar use. However, the prior art inventions do not disclose the same or similar elements as the present improved oxygen respirator, nor do they present the material components in a manner contemplated or anticipated in the prior art.

The majority of breathing devices include either filtered respirators or oxygen masks. There were few that provided an oxygen mask for emergency oxygen supply as well as a filtration system to prevent the inhalation of toxic fumes. In U.S. Pat. No. 6,659,102 to Sico, an oxygen mask filter system is shown which filters exhaled air from a patient to prevent the transfer of disease to medical personnel, the filter providing a plurality of vent apertures, a disk member attached to the exterior of the mask over the apertures, and a filter member attached to the interior of the mask. It could be situated to reverse the filtration of the air by exchange of the members to filter in reverse, although the filter does not appear to address toxic fumes, addressing only the issue of filtering air borne disease. An escape mask is defined in U.S. Pat. No. 5,709,204 to Lester, which provides a mask body with a connector ring containing a moveable valve, a spring clip for holding the valve in the connector ring, a connector insertable within the connector ring which displaces the valve to allow oxygen into the mask when the connector is inserted within the connector ring, a pin and openings to secure the pin to hold the connector to the connector ring and a break-away ring in the connector ring to allow disconnection while the pin is in place. There is a filtered air inlet in addition to the circular movable valve to permit breathing when the mask is disconnected from an oxygen supply. Both of these prior art breathing devices include reference to a seal around the mask to prevent the introduction of outside air except through the oxygen supply lines or the filtration systems, although not specific as to the components that form this air-tight of face conforming seal.

SUMMARY OF THE INVENTION

Historical evidence provides numerous instances where passengers have been exposed to toxic and dangerous contaminated bleed air fumes during in flight emergency situations. Current airplane oxygen masks provide the "yellow cup" masks which are poor fitting, lacking an airtight seal to the user's face and available only when the cabin pressure drops. It does not provide a safe breathing apparatus during a flume event, i.e., when harmful substances have infiltrated the breathable cabin air.

Fume events occur approximately once every one hundred commercial flights, often causing hysteria and safety concerns for passengers, according to the UK Committee on Toxicity in Food in a 2007 study. A fume event, as defined within the scope of this specification and claims, is an event wherein smoke or toxic fumes from burnt engine oil, combustion gasses from mechanical or electrical fires, or exhaust gasses from structural failures enter the passenger compartment of an airplane during flight. Presently, an emergency landing is required to protect the passengers from irritating and toxic contaminants which present themselves within the cabin, some visible and some invisible. Even in short exposure scenarios, current passengers have no protection against inhaling these fumes, resulting in side effects known as Aerotoxic Syndrome, causing headaches, dizziness, nausea, vomiting respiratory distress, respiratory failure and increased heart rate. Airlines, while addressing oxygen supply during cabin pressure failure, have not addressed protection to its passengers to provide protection during a fume event to prevent this Aerotoxic Syndrome.

The present improved emergency aircraft oxygen respirator provides a facial conforming replacement mask for the yellow cup oxygen masks, connecting to the same oxygen supply on passenger planes as the yellow mask, without modification to the current passenger airplane, the aircraft oxygen respirator also providing a rechargeable filtration system providing not only oxygen, but the filtration system preventing respiration of fumes during a fume event as well as the present loss of cabin pressure.

DESCRIPTION OF THE DRAWINGS

The following drawings are submitted with this utility patent application.

DESCRIPTION OF THE PREFERRED EMBODIMENT

An improved emergency aircraft respirator 10, as shown in FIGS. 1-5 of the drawings, provides a facial conforming replacement mask for the yellow cup oxygen masks, connecting to the same oxygen supply on passenger planes as the yellow mask, without modification to the current passenger airplane emergency oxygen system A, the aircraft oxygen respirator 10 providing not only emergency oxygen to passengers, but a filtration system preventing inhalation of harmful contaminants during a fume event as well as the present oxygen supplied during a loss of cabin pressure.

Figure 3:
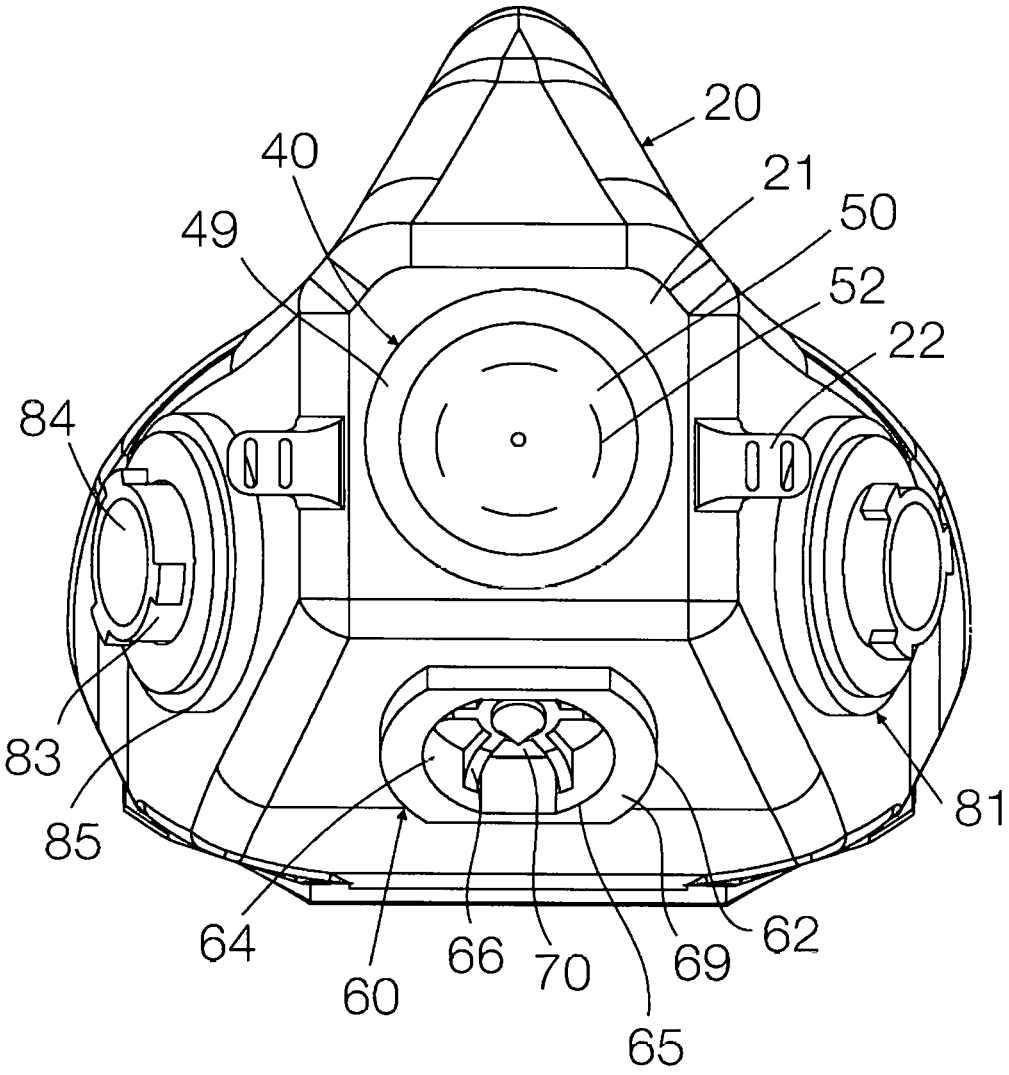
FIG. 3 is a view of the front surface of the improved emergency aircraft respirator without the connecting filter cartridge removed from the filter cartridge assembly.
Figure 4:
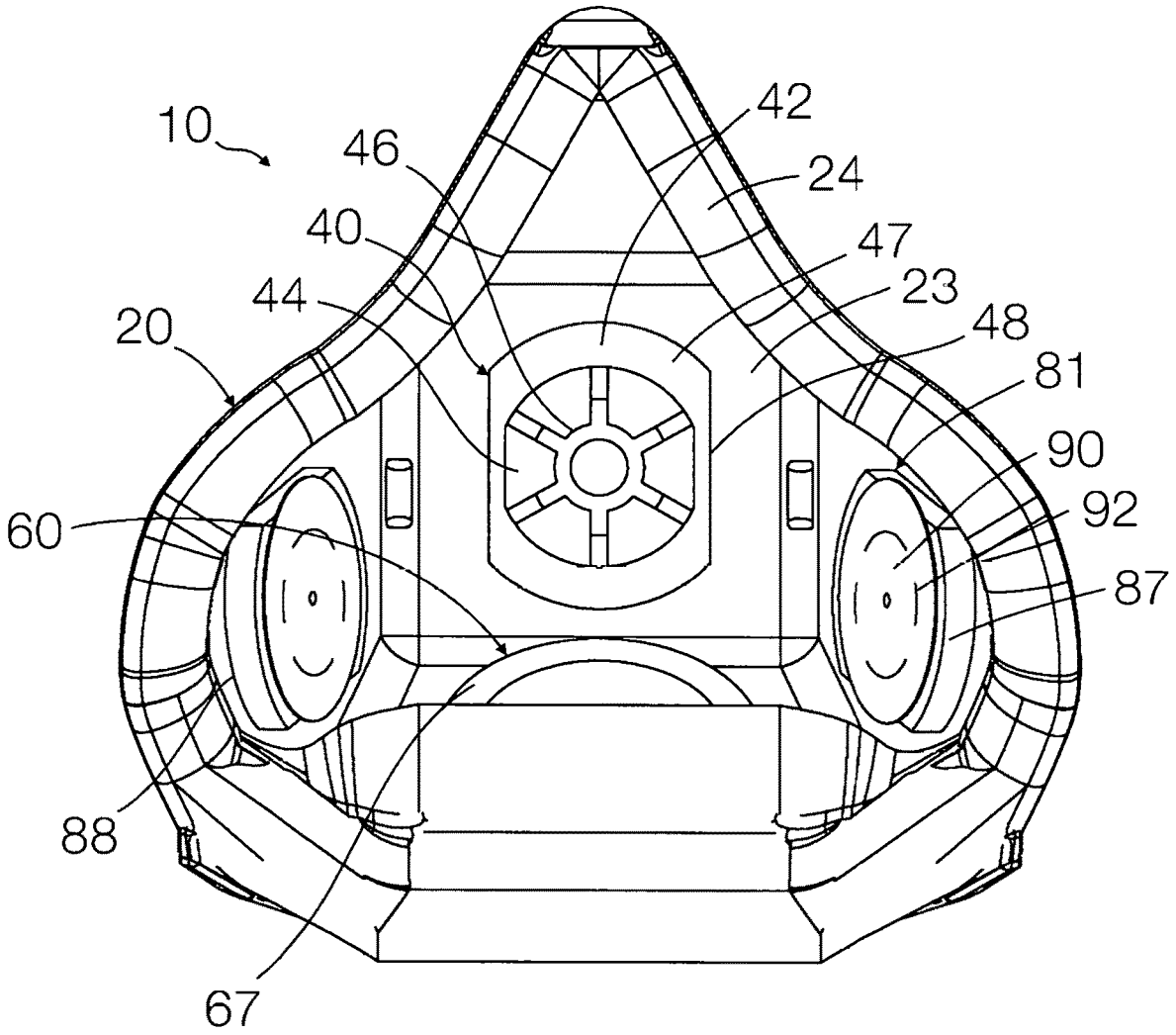
FIG. 4 is a view of the inner surface of the improved emergency aircraft respirator.

The improved emergency aircraft respirator 10 comprises a mask 20 which covers the lower portion of a person's face defining a front surface 21, FIG. 3, extending dual strap anchors 22 and an inner surface 23, FIG. 4, defining a face conforming outer perimeter liner 24, the mask 20 made of a deformable material which bends and conforms to the respective face of any person, creating a seal between the person's face and the outer perimeter liner 24 when worn under the pressure of the head strap 30 properly applied to head against the dual strap anchors 22.

It is preferred that the mask 20 be made out of a rubber, silicon or other soft pliable and shape-conforming polymeric materials which allows for both limited flexibility to follow and maintain close proximity to the cheeks, jaw and chin of a variety of passengers and to allow for sanitary cleansing. The materials selection should also require that it be biologically inert to minimize the risk of an allergic reaction of a passenger to the materials, avoiding such materials as latex or other known potential irritant materials. The mask 20 further defines a central nosepiece orifice 26, a lower central oxygen orifice 27, and at least one lateral filter cartridge orifice 28, the nosepiece orifice 26 aligning when properly worn with the person's nose and the oxygen orifice 27 aligning with the person's mouth.

Figure 2:
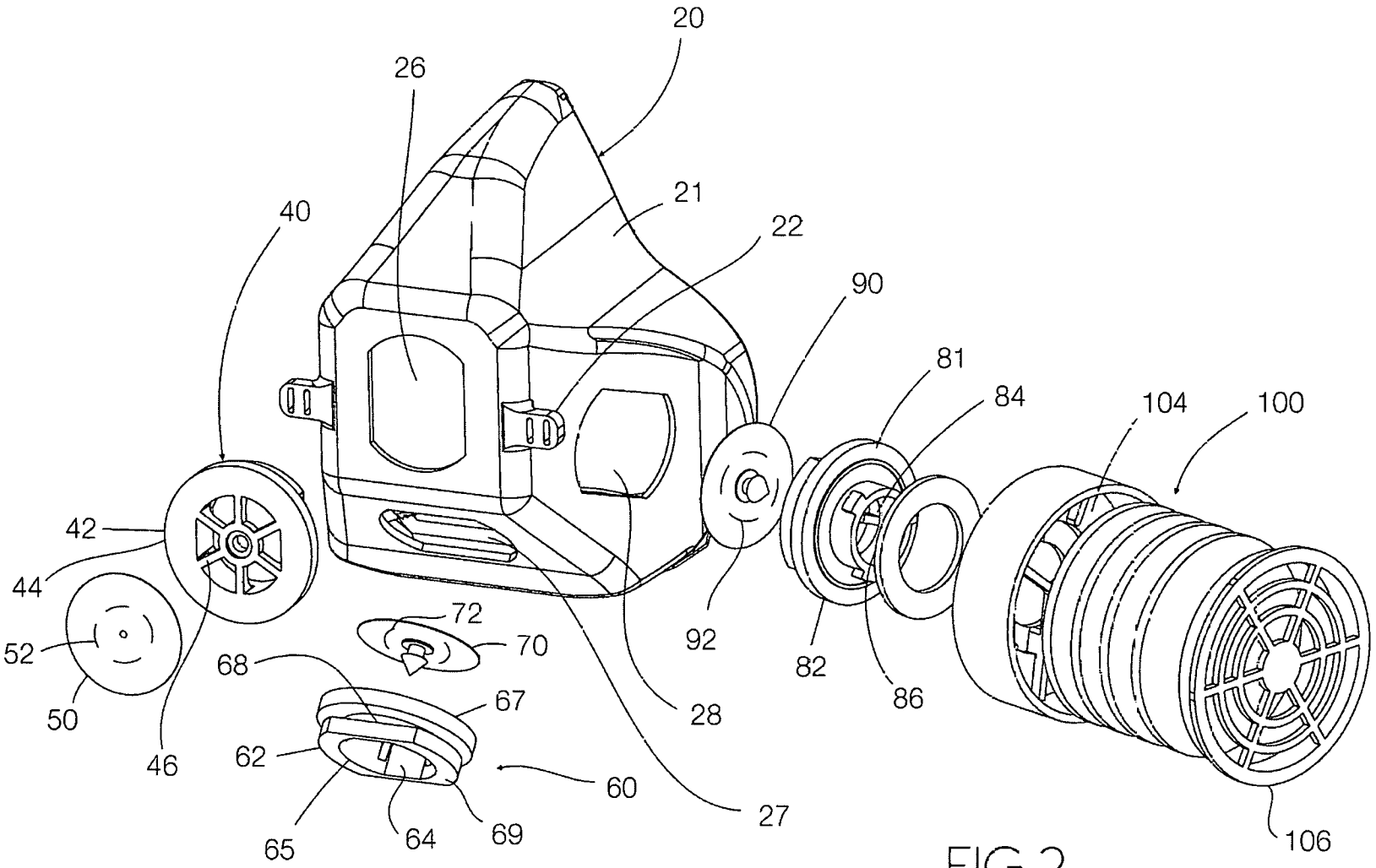
FIG. 2 is an expanded view of the improved emergency aircraft respirator components.

Within the central nosepiece orifice 26 is a nosepiece assembly 40, FIGS. 2-4. The nosepiece assembly 40 provides an external passage for exhaled air to be expelled from the mask 20 by the person wearing the mask to eliminate carbon dioxide gasses. In the regard, the nosepiece assembly 40 provides a rigid body 42 defining passage 44 having an inner spoked support 46, an inner connecting member 47, a nosepiece orifice channel 48 and an external support member 49, with the nosepiece orifice 26 being installed within the nosepiece orifice channel 48, placing the inner connecting member 47 on the inner surface 23 of the mask and the external support member 49 against the front surface 21 of the mask 20, forming an airtight seal between the nosepiece orifice 26 and the nosepiece assembly 40. Covering the passage 44 outside of the rigid body 42 is a first umbrella valve seal 50, FIGS. 2-3, having a plurality of expandable air seal passages 52, creating a one-way valve to allow exhaled air from the passenger to exit the mask, with the expandable air seal passages 52 opened when pushed away from the inner spoked support 46 to open each respective air seal passage and remaining closed during inhalation, being tightly held against the inner spoked support to maintain closure of each respective air seal passage 52. A nosepiece cover guard may be placed over the external support member to protect the first umbrella valve seal from damage during storage and operation, not shown.

Within the lower central oxygen line orifice 27 is an oxygen line connection assembly 60, FIGS. 1-4. The oxygen line connection assembly 60 provides an internal passage for freshly generated oxygen to be supplied within the mask 20 by the person wearing the mask. In the regard, the oxygen line connection assembly 60 provides a rigid body 62 defining passage 64 having an inner spoked support 66 defining a central oxygen line connection port 65, an inner connecting member 67, an oxygen orifice channel 68 and an external support member 69, with the oxygen line orifice 27 being installed within the oxygen orifice channel 68, placing the inner connecting member 67 on the inner surface 23 of the mask 20 and the external support member 69 against the front surface 21 of the mask 20, forming an airtight seal between the oxygen line orifice 27 and the oxygen line connection assembly 60. The central oxygen line connection port 65 is adapted to receive the same oxygen supply line A from the airplane, or the "yellow cup", which is replaced by the present improved emergency aircraft respirator forming an airtight seal upon the plane's oxygen supply line A. Covering the passage 64 inside the rigid body 62 is a second umbrella valve seal 70 having a plurality of expandable air seal passages 72, creating a one-way valve to allow inhaled air from the oxygen supply line A to be drawn into the mask 20, with the expandable air seal passages 72 opened when pulled away from the inner spoked support 66 to open each respective air seal passage and remaining close during exhalation, being tightly held against the inner spoked support 66 to maintain closure of each respective air seal passage. As readily seen, the operation of the first umbrellas seal 50 and second umbrella seal 70 are opposite, wherein the first umbrella seal 50 opens during exhalation from the inside of the mask to the outside, while the second umbrella seal 70 opens during inhalation from the outside of the mask to the inside. Both are sealed when there is no inspiration or expiration of air by the passenger.

Within the at least one lateral filter cartridge orifice 28 is a filter cartridge assembly 80, FIGS. 2-4. The filter cartridge assembly 80 defines a mask insertion member 81 and a connecting filter cartridge 100. In this regard, each mask insertion member 81 further defines a rigid body 82 forming a passage 84, the rigid body 82 further defining an external support member 85, an inner spoked support 86 defining an outer extension 83 for engagement and secure connection to the connecting filter cartridge 100, an inner connecting member 87, and a filter cartridge orifice channel 88, with the lateral filter cartridge orifice 28 being installed within the filter cartridge orifice channel 88, placing the inner connecting member 87 on the inner surface 23 of the mask 20 and the external support member 85 against the front surface 21 of the mask 20, forming an airtight seal between the filter cartridge orifice 28 and the mask insertion member 81. Covering the passage 84 outside of the rigid body 82 of each mask insertion member 81 is a third umbrella valve seal 90 having a plurality of expandable air seal passages 92, creating a one-way valve to allow filtered air from the airplane cabin to enter the mask 20 through the filter cartridge assembly 80, with the expandable air seal passages 92 are opened when drawn away from the inner spoked support 86 to open each respective air seal passage 92 and remaining closed during exhalation, being tightly held against the inner spoked support 86 to maintain closure of each respective air seal passage 92.

Figure 1:
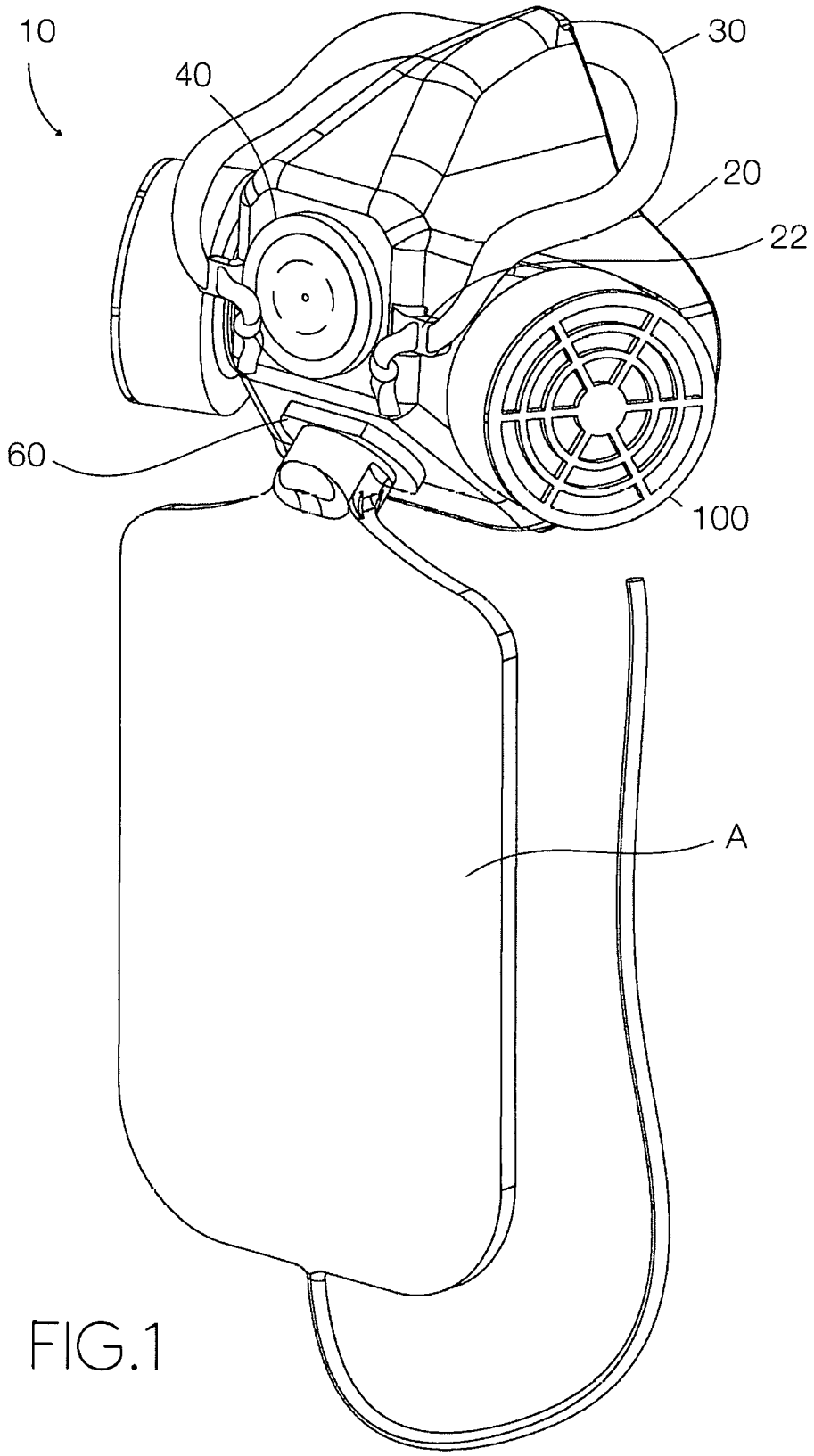
FIG. 1 is a front perspective view of the improved emergency aircraft respirator attached to an oxygen supply line of a commercial passenger airplane.
Figure 5:
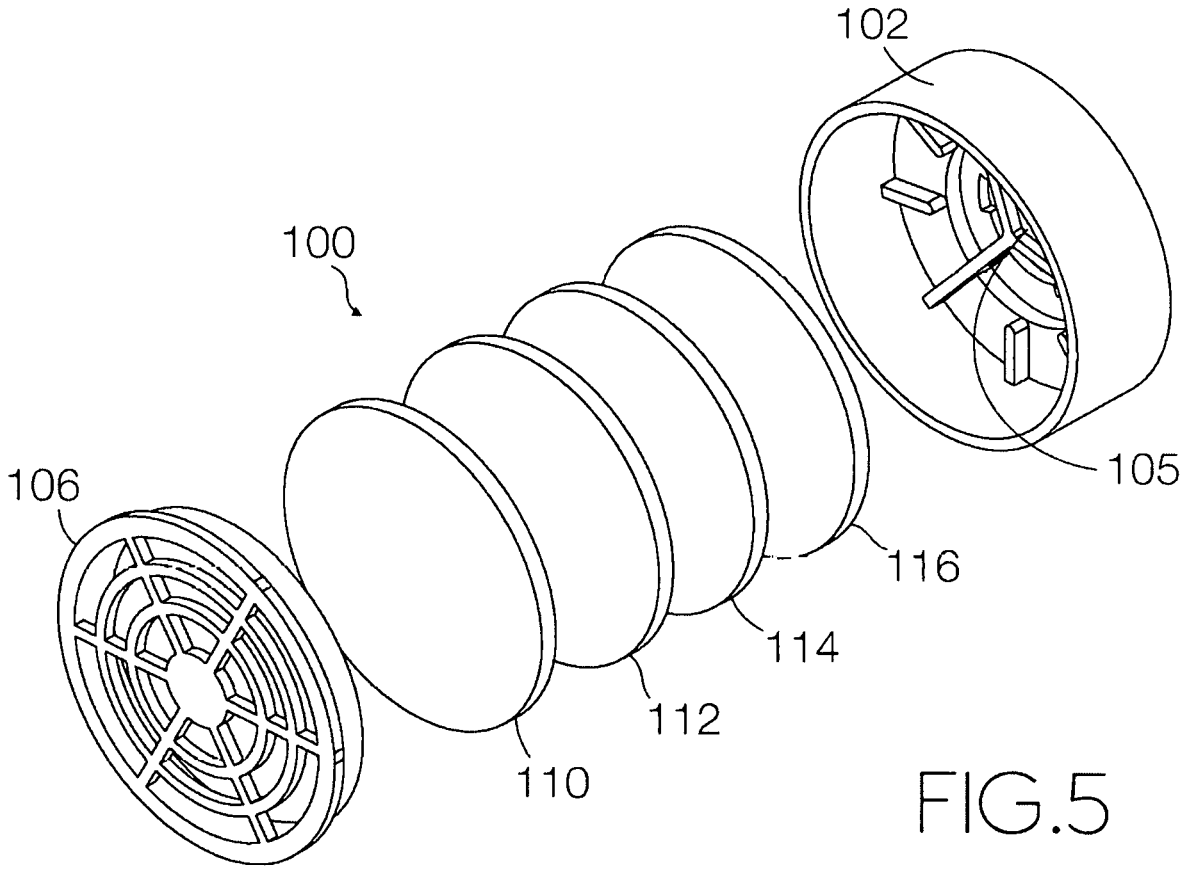
FIG. 5 is an isolated expanded view of the connecting filter assembly and the arrangement of the multiple layered filter pads.

The connecting filter cartridge 100, FIGS. 1-2 and 5, provides a base receiver 102 further defining a cavity 104 within which are stacked one or more filter pads to remove harmful contaminants from air breathed through the filter cartridge assembly 100, and an outer cartridge cap 106. It is the intent that each connecting filter cartridge 100 be rechargeable after each use and that each filter pad be disposable and replaced each time the mask is used. The base receiver 102 defines an inner rear extension receiver 105 which engages and secures the outer extension 83 of the mask insertion member 81 with the inner rear extension receiver 105 and outer extension 83 forming an airtight seal which directs air through the connecting filter cartridge 100 prior to entry into the passage 84 of the mask insertion member 81. The connection formed between the outer extension 83 and the inner rear extension receiver 105 is secured and unsecured for exchange and recharging of the connecting cartridge filter 100, with the drawing figures representing an embodiment of the connection where the engagement occurs as rotationally proffered. Air drawn though the connecting filter cartridge 100 is intentionally filtered to eliminate and prevent inhalation of harmful fumes during a fume event even when there is no loss of cabin pressure and supplemental oxygen may not be required.

The filter pads contained within the connecting filter cartridge 100, FIGS. 2 and 5, would preferably include at least one first filter pad 110 to filter air borne particles before the air can be further filtered, ideally in a range from 10 to 95 ($PM_{10}$), the first filter pad 110 made from sturdy cotton or other fabric materials having the preferable filter quality. The first filter pad 110 would be the outermost filter pad and closest to the outer cartridge cap 106. A second filter pad 112 would be provided to absorb smaller harmful particles which can prove to be toxic if inhaled during the fume event. These are likely combustion gasses that are emitted from combustion of panel materials including fabric, metal, wiring and insulation, as well as combustion from articles contained in the luggage and passenger compartments. Infusion of the second filter pad 112 with activated carbon is a cost effective suggestion for this second filter pad 112, with the activated carbon having the physical and chemical capacity to surround and hold these harmful and dangerous molecular particles. The third filter pad 114 is vital, especially where there is an actual fire. Fires produce carbon monoxide. Therefore, the third filter pad 114 would be imbedded (usually by soaking the third pad) in a solution of a catalyst which converts carbon monoxide to carbon dioxide. In addition, this third filter pad 114 may also provide the addition of ferrous sulfate to remove any chlorine from the cabin air, which is often a byproduct of burning airline insulation. A fourth filter pad 116, which would preferably be the innermost of the various filter pads lying against the rear extension receiver 105, contains an infused desiccant to remove moisture entering the mask 20 and to keep the other filters dry when they are not in use. This fourth filter pad 116 does not provide any filtration per se, but it was found to enhance the effectiveness of the second filter pad 112 and third filter pad 114 and the chemical and physical effectiveness of those filter pads.

After use, each mask 20 is sanitized before being restored to the airplane deployment compartment normally found in the overhead section of each passenger, with replacement of the filter pads being an essential part of the sanitization process. Each pad would be designed for single use, and the pads may be provided as a singular replacement element with directional instructions or labeling to ensure proper placement within the connecting filter cartridge 100. The mask material would provide for repeated use and easy disassembly for sterilization as would the other disclosed elements forming the respirator and including the various assemblies. The components of the improved emergency aircraft respirator are designed to be replaceable and reusable for several events, with the exception of the filter pads, as previously discussed. With the mask material being facially conforming, it should provide a safer and effective emergency mask for aircraft passengers and also significantly reduce the effects to the passengers during a fume event or cabin pressure loss by delivering more oxygen and blocking the introduction of the harmful contaminants.

While the improved emergency aircraft respirator 10 has been particularly shown and described with reference to a preferred embodiment thereof, it will be understood by those skilled in the art that changes in form and detail may be made therein without departing from the spirit and scope of the invention.

What is claimed is:

1. An improved emergency aircraft respirator providing a facially conforming replacement mask for a yellow cup oxygen masks located in the passenger compartments of passenger airplanes, connecting to a current passenger airplane emergency oxygen generating system, said improved emergency aircraft respirator supplying not only emergency oxygen to passengers during a loss of cabin pressure, but a filtration system preventing inhalation of harmful contaminants during a fume event, said improved emergency aircraft respirator comprising:

a mask conforming to a lower portion of a passenger's face, defining a front surface mounting dual strap anchors and an inner surface defining a face conforming outer perimeter liner, said mask made of a deformable material which bends and conforms to the respective facial contours of a passenger, creating a seal between said passenger's face and said outer perimeter liner when worn under the tension of a head strap properly worn by said passenger attaching to said dual strap anchors, said mask further defining a central nosepiece orifice, a lower central oxygen orifice, and at least one lateral filter cartridge orifice;

a nosepiece assembly providing an external passage for exhaled air to be expelled from said mask to eliminate carbon dioxide gasses sealingly engaged within said nosepiece orifice;

an oxygen line assembly providing for an attachment to a passenger airplane emergency oxygen generating system oxygen supply line to supply oxygen to the passenger sealingly engaging within said lower central oxygen orifice; and at least one filter cartridge assembly defining a mask insertion member sealingly engaging within said at least one lateral filter cartridge orifice and a connecting filter cartridge sealingly engaging said mask insertion member, said connecting filter cartridge defining a based receiver forming a cavity within which is contained:

a first filter pad to filter air borne particles before the air can be further filtered, a range from 10 to 95 ($PM_{10}$), said first filter pad made from sturdy cotton or other fabric materials having a filter quality wherein said first filter pad is the outermost filter pad and closest to said outer cartridge cap;

a second filter pad absorbing smaller harmful and dangerous molecular particles from combustion gasses that are emitted from combustion of panel materials including fabric, metal, wiring and insulation, as well as combustion from articles contained in a luggage and passenger compartments, said second filter pad infused with activated carbon having the physical and chemical capacity to surround and hold these harmful and dangerous molecular particles;

a third filter pad for the prevention of gasses generated during a fire, said third filter pad imbedded with a solution of a catalyst converting carbon monoxide to carbon dioxide and ferrous sulfate to remove any chlorine from the cabin air, which is often a byproduct of burning airline insulation; and a fourth filter pad, which is the innermost of the various filter pads lying against said base receiver, containing an infused desiccant to remove moisture entering said mask and to keep said first second and third filter pads dry when not in use, said fourth filter pad providing no filtration per se, but essential to enhance effectiveness of said second and third filter pads and the chemical and physical effectiveness of said filter pads.

2. The improved emergency aircraft respirator of claim 1, said nosepiece assembly further comprising:

a rigid body defining a passage having an inner spoked support;

an inner connecting member;

a nosepiece orifice channel; and an external support member, with said nosepiece orifice being installed within said nosepiece orifice channel, placing said inner connecting member on said inner surface of said mask and said external support member against said front surface of said mask, forming said airtight seal between said nosepiece orifice and said nosepiece assembly.

3. The improved emergency aircraft respirator of claim 1, said oxygen line assembly further comprising:

a rigid body defining a passage having an inner spoked support defining a central oxygen line connection port;

an inner connecting member;

an oxygen orifice channel; and an external support member, with said oxygen line orifice installed within said oxygen line orifice channel, placing said inner connecting member on said inner surface of said mask and said external support member against said front surface of said mask, forming an airtight seal between said oxygen line orifice and said oxygen line assembly, said central oxygen line connection port adapted to receive said same oxygen supply line from said yellow cup oxygen mask replaced by said present improved emergency aircraft respirator forming an airtight seal with said oxygen supply line.

4. The improved emergency aircraft respirator of claim 1, further comprising:

each said at least one mask insertion member further defining a rigid body forming a passage, an external support member, an inner spoked support defining an outer extension for engagement and secure connection to said connecting filter cartridge, an inner connecting member, and a filter cartridge orifice channel, with each said at least one lateral filter cartridge orifice installed within said at least one filter cartridge orifice channel, placing said inner connecting member on said inner surface of said mask and said external support member against said front surface of said mask, forming an airtight seal between said filter cartridge orifice and said mask insertion member; and said base receiver further defining an inner rear extension receiver engaging and securing said outer extension of said mask insertion member with said inner rear extension receiver and outer extension forming an airtight seal directing air through said connecting filter cartridge prior to entry into said passage of said mask insertion member, having a connection formed between said outer extension and said inner rear extension receiver connecting and disconnecting to exchange and recharge said connecting cartridge filter, each said first through fourth filter pads disposed and replaced after said mask is used.

5. The improved emergency aircraft respirator of claim 1, further comprising:

a first umbrella valve seal having a plurality of expandable air seal passages creating a one-way valve to allow exhaled air from said passenger to exit said mask from said nosepiece assembly, with said expandable air seal passages opened when pushed away from said nosepiece assembly to open each respective air seal passage and remain closed during inhalation, being tightly held against said nosepiece assembly;

a second umbrella valve seal having a plurality of expandable air seal passages, creating a one-way valve to allow inhaled air from the oxygen supply line to be drawn into said mask with said expandable air seal passages opened when pulled away from said oxygen line assembly to open each respective air seal passage and remaining close during exhalation, being tightly held against said oxygen line assembly to maintain closure of each respective air seal passage; and a third umbrella valve seal having a plurality of expandable air seal passages, creating a one-way valve to allow filtered air from said airplane cabin to enter said mask through said filter cartridge assembly, with said expandable air seal passages opened when drawn away from said mask insertion member to open each air seal passage and remain closed during exhalation, being tightly held against said mask insertion member to maintain closure of each respective air seal passage, wherein operation of said first umbrella valve seal and said second and third umbrella seals are opposingly situated, wherein the first umbrella seal opens during exhalation from said mask while said second and third umbrella seals open during inhalation from outside said mask, with all umbrella seals sealed when there is no inspiration or expiration of air by the passenger.

* * * * *